United States Patent [19]

Moos

[11] Patent Number: 4,659,011

[45] Date of Patent: Apr. 21, 1987

[54] METHOD AND APPARATUS FOR THE SPRAYING OF POWDER

[75] Inventor: Kurt Moos, Wil, Switzerland

[73] Assignee: Ransburg-Gema AG, Switzerland

[21] Appl. No.: 250,654

[22] Filed: Apr. 3, 1981

[30] Foreign Application Priority Data

Apr. 12, 1980 [DE] Fed. Rep. of Germany ..... 3014133

[51] Int. Cl.[4] ..... B05B 5/00; B05B 7/00; B05B 7/10

[52] U.S. Cl. ..... 239/3; 239/11; 239/704; 239/290; 239/405

[58] Field of Search ..... 239/3, 8, 11, 696, 704, 239/705, 143–290, 400, 403, 405, 406; 222/630

[56] References Cited

U.S. PATENT DOCUMENTS 3,873,024 3/1975 Probst et al. ..... 239/400
4,090,666 5/1978 Peck .
4,324,361 4/1982 Moos et al. ..... 239/3
4,343,436 8/1982 Lehmann ..... 239/143

FOREIGN PATENT DOCUMENTS 1814809 7/1970 Fed. Rep. of Germany .
2114662 6/1972 France .
2029271 3/1980 United Kingdom .

*Primary Examiner*—Andres Kashnikow
*Attorney, Agent, or Firm*—Ostrolenk, Faber, Gerb & Soffen

[57] ABSTRACT

A method of and apparatus are disclosed for spraying powder, particularly for the coating of articles, by introducing a spray gas into the powder as the latter is expelled from a spray opening. An additional gas is injected into the stream of powder upstream of the point where the spray gas is introduced, in such a manner as to exert a cyclone effect on the stream of powder, force the powder radially outward and simultaneously drive it in the direction of flow of the powder.

18 Claims, 1 Drawing Figure

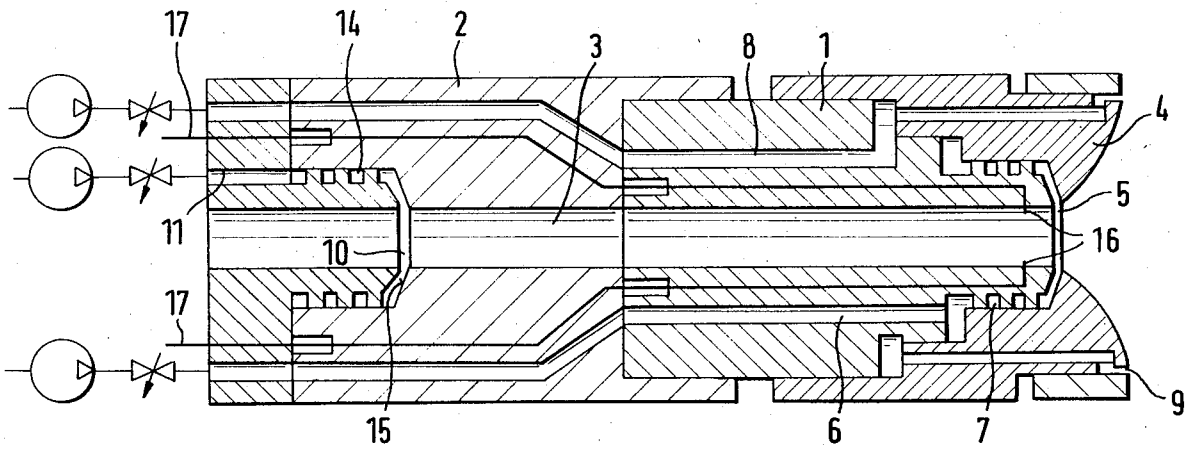
4
5
16
9
7
1
6
8
3
2
14
10
15
17
11
17

METHOD AND APPARATUS FOR THE SPRAYING OF POWDER

BACKGROUND OF THE INVENTION

The present invention relates to a method and apparatus for the spraying of powder, particularly for the coating of articles by means of introducing, upon the expulsion of the powder from a spray opening, a gas which sprays the powder.

Such a method and a corresponding apparatus have been proposed in German Patent Application P 28 52 412.1-52, the applicant in which application is the assignee of the present application. This generally corresponds to U.S. application 98,345, filed Nov. 29, 1979, now U.S. Pat. No. 4,324,361, incorporated herein by reference. Comparable methods and apparatus are also shown in DE-OS 14 27642 and DE-OS 17 77284.

SUMMARY OF THE INVENTION

The object of the present invention is to provide an improved method of and apparatus for spraying to obtain a more uniform powder concentration and to impart a more favorable speed to the powder particles in the spray jet or spray cloud. This will improve the quality of the coating, causing fewer rejects of coated articles and less waste of powder due to particles being scattered or bouncing off the articles during the coating process.

This object is achieved according to the method of the invention by introducing an additional gas flow into the stream of powder in such a manner that the powder is forced radially outward, with the result that the concentration of powder in the stream increases in the radially outer portion of the stream relative to the radially inner portion thereof. The additional gas is introduced into the stream of powder sufficiently far upstream of the point where the spray gas is introduced that the stream of powder retains this radially unequal distribution of powder up to the point of introduction of the spray gas. It has been found that this results in a more uniform coating being achieved.

An apparatus for the spraying of powder, especially for the coating of articles, according to the invention has a spray nozzle at the downstream end of a powder channel and a spray gas outlet at the spray nozzle. An additional gas outlet discharges into the powder channel in such a manner that additional gas fed through it tends to force the powder particles in the powder channel radially outward to produce the abovedescribed distribution.

The outlet of the additional gas is designed to exert a cyclone effect on the stream of powder within the powder channel by forming a vacuum region therein, similar to what occurs in a Venturi nozzle. The additional gas outlet must be arranged sufficiently far upstream from the spray-gas outlet that this cyclone effect can be fully developed. It has been found that the powder that is forced radially outward is picked up better by the spray gas and is sprayed in a powder jet or cloud of more uniform concentration than is possible with conventional methods and apparatus. Furthermore, in the case of an embodiment utilizing electrodes to charge the powder, the powder is more effectively charged using the arrangement of the invention, which in turn leads to better spraying and to a stronger force of attraction between the object to be coated and the powder. The powder particles also adhere better to the article to be coated.

Other objects and features of the invention will be apparent from the following description and the accompanying drawings.

BRIEF DESCRIPTION OF THE FIGURE

The sole FIGURE is a sectional view of an apparatus embodying the principles of the present invention.

DETAILED DESCRIPTION OF THE PREFERRED EMBODIMENT

The drawing shows a powder spray device for the coating of articles according to the present invention. The device comprises a spray part 1 and an attachment part 2. (Alternatively the spray part 1 may be a spray gun, which is well known per se, to the upstream end of which the attachment part 2 is attached.) A powder channel 3 extends axially through both the spray part 1 and the attachment part 2. Powder coating material is conveyed through channel 3 for spraying by a propellant gas. The front downstream end of the spray part 1 forms a spray nozzle 4. A spray outlet 5 which is fed from a spray-gas channel 6 with spray gas, preferably air, opens into nozzle 4. Threadlike turns 7 of the spray gas channel 6 permit the spray gas to discharge substantially tangentially and obliquely into the stream of powder in channel 3 relative to the direction of flow of the powder in the channel 3.

Another gas channel 8 terminates in the form of an annular slot 9 surrounding the nozzle 4. A gas, preferably air, ejected via the annular slot 9 serves to form a gas cover which surrounds the cloud of powder emerging from the nozzle 4 and imparts a desired shape to the cloud.

An additional gas outlet 10 is provided in the attachment part 2 and is fed by means of an additional gas channel 11. Threadlike turns 14 provided at the downstream end of chanel 11 permit the additional gas, which is preferably air, to flow substantially tangentially from the outlet 10 into the powder channel 3. The walls 15 of the additional gas outlet 11 extend obliquely relative to the direction of flow of the powder in channel 3 so that the additional gas imparts to the powder in the channel 3 not only a radially outward-directed component of velocity but also an axial component of acceleration. The walls 15 of the additional gas outlet 10 converge, like a nozzle, in the direction of flow in channel 3, i.e. they define an annular slot nozzle surrounding channel 3. The additional gas is injected into the channel 3 via additional outlet 10 in such a direction and with such a velocity that a Venturi-like suction is produced in channel 3, the direction of the suction being downstream and radially outward.

As a result of the novel method and apparatus described above, the concentration of powder in a cross-section of the stream in channel 3 increases with radial distance from the center of channel 3. It has been found that with this distribution of powder, the powder that is forced radially outward is entrained more effectively by the spray gas, and that the resulting powder jet has a more uniform cross-section than is conventionally obtainable.

The additional gas outlet 10 is preferably located between 5 cm. and 30 cm., and especially preferably about 10–20 cm., upstream of the upstream end of nozzle 4. This spacing ensures that the cyclone effect of the additional gas stream has sufficient time and space to have the desired effect before the powder stream in channel 3 reaches the spray nozzle 4.

Electrodes 16 arranged in the powder channel 3 between the additional gas outlet 10 and the spray-gas outlet 5 charge the powder electrostatically, in a manner and for a purpose that are well known. The electrodes 16 are supplied with power via leads 17 from a source of high voltage (not shown). Electrostatic charging of the powder in this manner further improves the quality of the spraying, by improving the adherence of the powder to the object, as is well known. It has also been found that with the apparatus and method of the invention, the powder that is forced radially outward is more effectively charged by the electrodes 16 than has heretofore been possible.

The present invention may be embodied in other specific forms without departing from the spirit or essential attributes thereof and, accordingly, reference should be made to the appended claims, rather than to the foregoing specification, as indicating the scope of the invention.

What is claimed is:

1. A method for spraying powder, said method comprising the steps of:

conveying to a spray device a stream of powder to be sprayed;

introducing a spray gas into said stream at said spray device to form the powder emerging therefrom into a spray cloud; and injecting an additional gas into said stream with a tangential and with an axial downstream component of velocity, at a point between about 5 cm. and about 30 cm. upstream of the point where said spray gas is introduced, in such a manner as to cause the concentration of said powder to increase as a function of radial distance in said stream from the axis thereof and to retain this radially unequal distribution of powder from a point where said additional gas is introduced down to a point where said spray gas is introduced.

2. The method of claim 1, wherein said additional gas is injected in such a manner as to produce suction within said stream.

3. The method of claim 2, wherein said suction has a radially outward component.

4. The method of claim 3, wherein said suction is substantially radially outward and in the direction of flow of said stream.

5. The method of claim 1, wherein said additional gas is injected between about 10 cm. and about 20 cm. upstream of the point where said spray gas is introduced.

6. The method of claim 1, wherein said spray gas and said additional gas are the same gas.

7. The method of either of claims 1 or 6, wherein said additional gas is air.

8. The method of claim 1, further comprising the step of electrostatically charging the powder at a point downstream of the injection of said additional gas and upstream of the point at which said spray gas is introduced.

9. An apparatus for spraying powder, said apparatus comprising:

a spray device having a mouth;

channel means for conveying a stream of a powder coating material to be sprayed to said mouth for spraying; said channel means having an axis, generally parallel to which said stream moves;

said spray device having spray gas outlet means for introducing a spray gas into said stream at said mouth to form the powder contained in said stream into a powder cloud as it leaves said spray device; and additional gas outlet means located at a point between about 5 cm. and about 30 cm. upstream of said spray gas outlet means in said stream for injecting an additional gas into said stream with a tangential component of velocity and obliquely relative to the direction of motion of said stream in said channel means in such a manner as to cause the concentration of powder in said stream to increase as a function of radial distance in said stream from said axis of said channel means and to retain this radially unequal distribution of powder from the additional gas outlet means down to the spray gas outlet means.

10. The apparatus of claim 9, wherein said additional gas outlet means comprises an annular slot nozzle disposed circumferentially surrounding said channel means.

11. The apparatus of claim 10, wherein said additional gas outlet means comprises walls defining said annular slot nozzle, said walls converging in a direction along said channel means toward said spray device.

12. The apparatus of claim 9, wherein said additional gas outlet means is for injecting said additional gas into said stream in such a manner as to produce suction in said stream.

13. The apparatus of claim 12, wherein said additional gas outlet means is adapted to produce radially outward suction in said stream.

14. The apparatus of claim 13, wherein said additional gas outlet means is further adapted to produce suction that is oblique relative to the direction of motion of said stream in said channel means.

15. The appartus of claim 9, wherein said additional gas outlet means is disposed for injecting said additional gas into said stream at a point between about 10 cm. and about 20 cm. upstream of said mouth.

16. The apparatus of claim 9, further comprising electrostatic charging means disposed in said channel means upstream of said mouth, for electrostatically charging the powder in said stream.

17. A method for spraying powder, said method comprising the steps of:

conveying to a spray device a stream of powder to be sprayed;

introducing a spray gas into said stream at said spray device to form the powder emerging therefrom into a spray cloud; and injecting an additional gas into said stream with a tangential and with an axial downstream component of velocity, at a point upstream of the point where said spray gas is introduced, in such a manner as to cause the concentration of said powder to increase as a function of radial distance in said stream from the axis thereof and to retain this radially unequal distribution of powder from a point where said additional gas is introduced down to a point where said spray gas is introduced.

18. An apparatus for spraying powder, said apparatus comprising:

a spray device having a mouth;

channel means for conveying a stream of a powder coating material to be sprayed to said mouth for spraying; said channel means having an axis, generally parallel to which said stream moves;

said spray device having spray gas outlet means for introducing a spray gas into said stream at said mouth to form the powder contained in said stream into a powder cloud as it leaves said spray device; and additional gas outlet means upstream of said spray gas outlet means in said stream for injecting an additional gas into said strream with a tangential component of velocity and obliquely relative to the direction of motion of said stream in said channel means in such a manner as to cause the concentration of powder in said stream to increase as a function of radial distance in said stream from said axis of said channel means and to retain this radially unqeual distribution of powder from the additional gas outlet means down to the spray gas outlet means.

* * * * *